US010777912B2

(12) United States Patent
Sachs et al.

(10) Patent No.: US 10,777,912 B2
(45) Date of Patent: Sep. 15, 2020

(54) ELECTRICAL CONTACT ELEMENT AND METHOD FOR ALTERING MECHANICAL AND/OR ELECTRICAL PROPERTIES OF AT LEAST ONE AREA OF SUCH

(71) Applicant: TE Connectivity Germany GmbH, Bensheim (DE)

(72) Inventors: Soenke Sachs, Frankfurt am Main (DE); Volker Seipel, Bensheim (DE); Helge Schmidt, Speyer (DE); Felix Greiner, Griesheim (DE); Christian Gregor, Zwingenberg (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/834,600

(22) Filed: Dec. 7, 2017

(65) Prior Publication Data

US 2018/0097295 A1 Apr. 5, 2018

Related U.S. Application Data

(63) Continuation of application No. PCT/EP2016/062889, filed on Jun. 7, 2016.

(30) Foreign Application Priority Data

Jun. 8, 2015 (DE) ..... 10 2015 210 460

(51) Int. Cl.

| | |
|---|---|
| ***H01R 4/18*** | (2006.01) |
| ***H01R 13/03*** | (2006.01) |
| ***H01R 4/62*** | (2006.01) |

(52) U.S. Cl.

CPC ..... *H01R 4/188* (2013.01); *H01R 4/62* (2013.01); *H01R 13/03* (2013.01)

(58) Field of Classification Search

CPC . H01R 4/188; H01R 4/18; H01R 4/62; H01R 13/03

USPC ..... 439/874, 62

See application file for complete search history.

(56) References Cited

U.S. PATENT DOCUMENTS

| | | | | |
|---|---|---|---|---|
| 2,897,091 A | | 7/1959 | Homer et al. | |
| 3,818,415 A | | 6/1974 | Evans et al. | |
| 5,136,365 A | * | 8/1992 | Pennisi | H01L 21/563 148/24 |
| 5,213,715 A | * | 5/1993 | Patterson | C08K 9/10 252/511 |
| 5,307,562 A | * | 5/1994 | Denlinger | H01R 13/03 29/882 |

(Continued)

FOREIGN PATENT DOCUMENTS

| | | |
|---|---|---|
| CN | 1147707 A | 4/1997 |
| CN | 1636652 A | 7/2005 |

(Continued)

OTHER PUBLICATIONS

Patent Translation of JPH0688214, dated Feb. 8, 2018, 6 pages.

(Continued)

*Primary Examiner* — Peter G Leigh

(74) *Attorney, Agent, or Firm* — Barley Snyder

(57) ABSTRACT

An electrical contact comprises an electrically conductive contact material and a plurality of particles adhered to an area of the contact material. At least some of the particles have a portion penetrating into the contact material.

20 Claims, 1 Drawing Sheet

(56) References Cited

U.S. PATENT DOCUMENTS 5,837,119 A * 11/1998 Kang ..... C25C 5/02 205/74
5,939,786 A * 8/1999 Downes, Jr. ..... H01L 21/4853 257/734
6,168,976 B1 * 1/2001 Haley ..... H01L 21/6835 257/181
6,238,599 B1 * 5/2001 Gelorme ..... H01B 1/22 252/512
6,323,432 B1 * 11/2001 Campbell ..... H01L 23/3733 117/903
6,331,119 B1 * 12/2001 Bernier ..... H01L 24/83 174/117 A
6,425,772 B1 * 7/2002 Bernier ..... H01L 24/83 174/117 A
6,518,168 B1 * 2/2003 Clem ..... B05D 1/283 257/E21.171
7,034,403 B2 4/2006 Divigalpitiya et al.
7,622,375 B2 * 11/2009 Kisu ..... C23C 26/00 257/E21.011
8,936,874 B2 * 1/2015 Shi ..... B82Y 30/00 429/217
9,009,962 B2 * 4/2015 Sugie ..... H01R 13/03 29/870
9,667,015 B2 * 5/2017 Schmidt ..... H01R 13/03
2005/0155694 A1 * 7/2005 Sim ..... C23C 24/08 156/81
2005/0233065 A1 10/2005 Kisu et al.
2010/0025255 A1 2/2010 Su et al.
2013/0072075 A1 3/2013 Kayamoto
2013/0273787 A1 * 10/2013 Mitose ..... H01R 4/185 439/878
2014/0017393 A1 * 1/2014 Schmidt ..... H01R 13/03 427/8
2014/0097002 A1 * 4/2014 Sachs ..... H05K 1/02 174/250
2014/0099450 A1 * 4/2014 Sachs ..... C23C 14/5873 427/552
2014/0102759 A1 * 4/2014 Schmidt ..... H01H 1/02 174/126.1
2014/0302729 A1 * 10/2014 Kodama ..... H01R 4/62 439/877
2014/0378009 A1 12/2014 Yamada et al.
2015/0060416 A1 * 3/2015 Schmidt ..... H01J 37/305 219/121.18
2015/0126026 A1 * 5/2015 Sachs ..... B23K 15/0006 438/598
2015/0147923 A1 5/2015 Todo et al.
2016/0109480 A1 * 4/2016 Han ..... G01R 1/0433 324/756.02

FOREIGN PATENT DOCUMENTS

CN 1771627 A 5/2006
CN 101638790 A 2/2010
CN 102859799 A 1/2013
CN 103503239 A 1/2014
JP 63024068 A 2/1988
JP 63109162 A 5/1988
JP H0688214 A 3/1994
JP H06296920 * 10/1994 ..... B05D 1/02
JP H06296920 A 10/1994
JP 2001068194 A 3/2001
JP 2012-144758 A 8/2012
JP 2014164934 A 9/2014

OTHER PUBLICATIONS

Description of JPH0688214, downloaded from https://worldwide.espacenet.com, dated Mar. 29, 1994, 6 pages.
Notification, The International Search Report and the Written Opinion of the International Searching Authority, dated Aug. 4, 2016, 13 pages.
Abstract of JPS63024068, dated Feb. 1, 1988, 1 page.
Abstract of JPS63109162, dated May 13, 1988, 2 pages.
Abstract of JP2001068194, dated Mar. 16, 2001, 1 page.
Abstract of JPH06088214, dated Mar. 29, 1994, 2 pages.
Chinese First Office Action with English translation, Chinese Patent Application No. 201680033100.1, dated Nov. 29, 2018, 15 pages.
Abstract of CN 1147707A, dated Apr. 16, 1997, 1 page.
Chinese Second Office Action with English translation, Chinese Patent Application No. 201680033100.1, dated Jul. 15, 2019, 17 pages.
Abstract of JP 2014164934 A, dated Sep. 8, 2014, 1 page.
Abstract of JPH06296920A, dated Oct. 25, 1994, 2 pages.
Abstract of JP 2012-144758 A, dated Aug. 2, 2012, 1 page.
The Third Office Action and English translation, Application No. 201680033100.1, dated Feb. 6, 2020, 16 pages.
Indian Examination Report, dated Dec. 20, 2019, 6 pages.

* cited by examiner

ELECTRICAL CONTACT ELEMENT AND METHOD FOR ALTERING MECHANICAL AND/OR ELECTRICAL PROPERTIES OF AT LEAST ONE AREA OF SUCH

CROSS-REFERENCE TO RELATED APPLICATIONS

This application is a continuation of PCT International Application No. PCT/EP2016/062889, filed on Jun. 7, 2016, which claims priority under 35 U.S.C. § 119 to German Patent Application No. 102015210460.5, filed on Jun. 8, 2015.

FIELD OF THE INVENTION

The present invention relates to an electrical contact and, more particularly, to an electrical contact having an area with different mechanical and/or electrical properties.

BACKGROUND

For known electrical contacts such as contact pins, female connectors, crimp connectors, or cable shoes, it is frequently necessary for particular areas of the contact to have properties different from those of the contact material from which the contact is manufactured. For example, it can be necessary for a contact surface of the contact, which makes a connection to a further contact, to have increased conductivity, improved resistance to corrosion, or a greater mechanical hardness in order to improve an electrical connection to another contact. It is also frequently necessary to increase the durability or lifespan of the contact for frequent connections.

Expensive and complex methods are generally used in order to produce such areas of the contact. For example, at least one further material is deposited onto the contact material by electroplating or chemical vapor deposition. Such methods lead to desired results but are generally costly and require several working steps, high expenditure on material, and generally have a low degree of selectivity.

SUMMARY

An electrical contact according to the invention comprises an electrically conductive contact material and a plurality of particles adhered to an area of the contact material. At least some of the particles have a portion penetrating into the contact material.

BRIEF DESCRIPTION OF THE DRAWINGS

The invention will now be described by way of example with reference to the accompanying figures, of which.

DETAILED DESCRIPTION OF THE EMBODIMENTS

Figure 1:
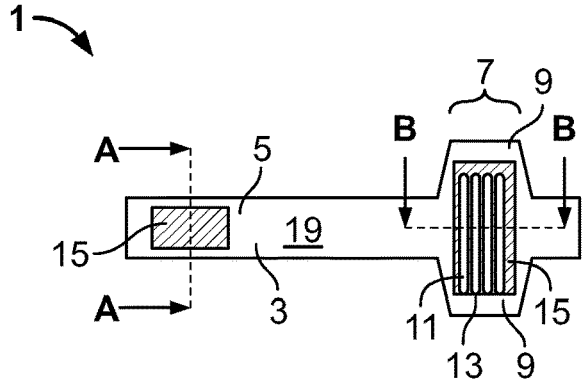
FIG. 1 is a plan view of a contact according to the invention.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

An electrical contact 1 according to an embodiment is shown in FIG. 1. The contact 1 is made from an electrically conductive contact material 3 and has at least one contact surface 5 for connection to another contact. In an embodiment, the electrical contact 1 is formed by stamping and bending from the contact material 3. In other embodiments, the electrical contact 1 is formed as a solid part.

As shown in FIG. 1, the contact 1 has a crimp section 7 with a pair of crimp flanks 9. The crimp section 7 has a surface structure 11 which can improve the electrical and mechanical connection to an electrical conductor which is retained in the crimp section 7; FIG. 1 shows the contact 1 with folded back crimp flanks 9 without an electrical conductor being retained in the crimp section 7. In the shown embodiment, the surface structure 11 has a plurality of grooves 13 impressed in the contact material, the grooves 13 are longitudinal recesses in the contact material 3. In other embodiments, the surface structure can have other forms, such as ribs, knobs, or folding edges, and other areas of the contact 1 can have surface structures 11.

In the shown embodiment, the electrical contact 1 has two areas 15 in which particles 17 are deposited on the contact material 3. A material of the particles 17 can be selected for the desired application; to improve the electrical and/or mechanical properties of an area 15, the particles 17 may be gold, silver, tin, brass, bronze, zinc, or alloys of such metals. In order to increase only the mechanical friction in the area 15 of the contact material 3, for example, particles 17 of non-conductive materials may also be used.

In an embodiment, the particles 17 are deposited on the contact material 3 by gas dynamic cold spraying. In an embodiment, the particles 17 are deposited at supersonic speed in a particle beam, for example, at speeds of more than 400 meters per second. In other embodiments, the particles 17 have a speed between 500 and 1000 meters per second. The speed dictates how deep the particles 17 in the area 15 penetrate into the contact material 3 and how well they adhere thereto. At higher speed, the particles 17 can penetrate more deeply into the contact material 3 but are themselves also more strongly deformed by the forces which arise when they impact on the contact 1. The speed can be selected depending on the desired field of use, the selected material and the desired form of a coating formed by the particles 17.

Solid or dry particles 17 can be used, as a result of which it is possible to dispense with wet-chemical methods of deposition. It is likewise possible to dispense with firstly placing materials which are intended to be deposited onto the contact material 3 into a liquid or gaseous aggregate state.

In order to achieve a high spatial resolution when depositing particles 17 onto the contact material 3, a mask can be used which allows a particle beam to only reach sections which are not covered by the mask. The mask is then located between a particle source, for example a nozzle of a gas dynamic cold spraying device and the contact 1.

If required for certain properties, the contact 1 can also be additionally coated, for example galvanically, through printing techniques or through chemical vapor deposition.

A first area 15 having particles 17 overlaps the contact surface 5 and a second area 15 having particles 17 overlaps the crimp section 7. Exemplary configurations of the first area 15 which overlaps the contact surface 5 are described in greater detail below with reference to FIGS. 2-5. Configurations of the second area 15 which overlaps the crimp section 7 are described in greater detail below with reference to FIGS. 6-7.

Figure 2:
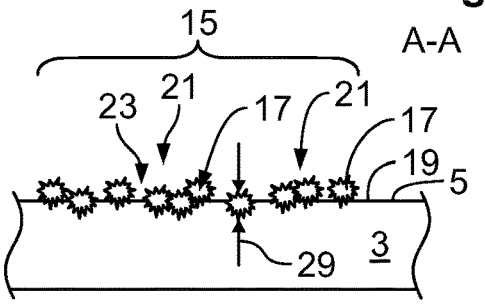
FIG. 2 is a sectional view through a contact surface of the contact having a single-layer particle coating.

A first area 15 with particles 17 overlapping the contact surface 5 is shown in FIG. 2. The particles 17 are arranged in an adherent manner on a surface 19 of the contact material 3. The depicted arrangement and shape of the particles 17 is merely exemplary; in principle, any form which allows the particles 17 to be deposited sufficiently quickly onto the contact material 3 is possible. For example, the particles 17 can be spherical, drop-shaped, or can take the form of non-uniform fragments. If it is crystal-forming material, a particle 17 can also have a cubic or other angularly shaped form. In an embodiment, the particles 17 have diameters between 1 and 50 □m.

Figure 3:
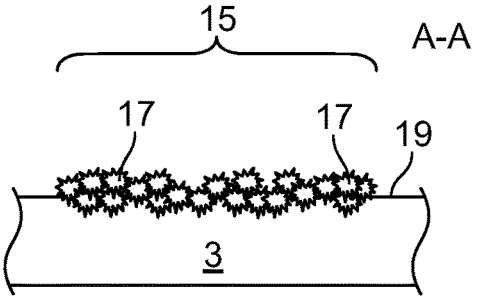
FIG. 3 is a sectional view through the contact surface having a partial multilayer particle coating.

At least some of the particles 17 have a portion penetrating into the contact material 3, as shown in FIGS. 2 and 3, and are mechanically anchored therein as a result of the particles 17 hitting the contact 1 at a high speed. At these locations, the contact material 3 is displaced at least partially by the particles 17. It can likewise be possible that undulations or elevations in the surface 19 are formed by particles 17 bouncing off of the contact material 3; for example, crater-like structures can be formed in the surface 19. The partial deformation of the contact material 3 can serve to improve the adhesion of the particles 17 to the surface 19 by surface-fusing. In addition, a reshaping of the surface 19 can increase a surface roughness.

Some of the particles 17 form particle conglomerates 21, as shown in FIG. 2, at which several particles 17 adhere to one another. The particles 17 of the conglomerates 21 can partially penetrate into one another. Particles 17 can also form a network-like structure on the surface 19 in the area 15. Between some of the individual particles 17 and particle conglomerates 21, there can also be free locations 23 through which the contact material 3 is accessible from the outside. As a result of this structure, the contact 1 can have a high degree of roughness in the area 15. Such a structure can arise, for example, if only a thin or simple layer of particles 17 is intended to be formed. In this case, particles are deposited onto the contact material 3 either at lower speed or with a smaller particle density, which means that the contact material 3 is not entirely coated.

As shown in FIG. 3, in an embodiment, the particles 17 in the area 15 may be arranged at least partially in multilayers on the contact material 3. In this case, adjacent particles 17 penetrate at least partially into one another. As a result, not only is the layer of particles 17 which are directly connected to the contact material 3 securely retained, but so too are successive layers of particles 17.

Figure 4:
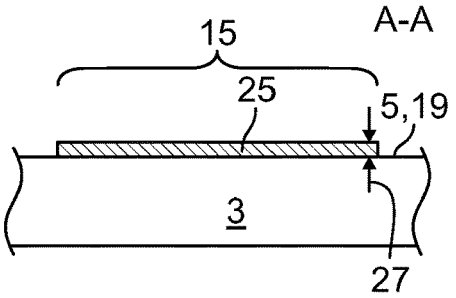
FIG. 4 is a sectional view through the contact surface of FIG. 2 having a coating formed from the single-layer particle coating.

FIG. 4 shows an area 15 as shown in FIG. 2 but following heating of the area 15, for example, selectively by electron beams. Alternatively, other energy-rich types of radiation such as, for example, lasers, X-rays or matter jets made from parts other than electrons, can also be used. The particles 17 are fused into one layer 25 by heating. The layer 25 can be continuous and uniformly cover the surface 19 in the area 15. However, if sufficient particles 17 were not available to fully cover the surface 19 or if a layer of particles 17 had many free locations 23, the layer 25 can also be formed such that it is not uniform.

The layer 25 shown in FIG. 4 substantially consists of the material of the particles 17. In other words, no formation of an alloy made up of the material of the particles 17 and the contact material 3 takes place. This can, for example, be achieved through rapid heating by electron beams in which the particles 17 and/or the contact material 3 are generally not heated higher than their melting temperatures. Alternatively, the contact 1 is heated at least in sections such that the material of the particles 17 is mixed with the contact material 3 and alloys form. This can be made to depend on the planned application. As a result of a melting of the particles 17, the thickness 27 of the layer 25 is generally smaller than a particle diameter 29 shown in FIG. 2

Recesses or undulations in the surface 19 which possibly arise due to the impact of particles 17 can remain in existence so that the material of the fused particles 17 fills them. If, as a result, the layer 25 penetrates partially into recesses in the surface 19, the layer 25 adheres better to the contact material 3. As an alternative to the depicted layer formation, particles 17 can also be only partially surface-fused by heating, so that these connect to one another more strongly or the surface of the particles 17 and/or of particle conglomerates 21 is smoothed.

Figure 5:
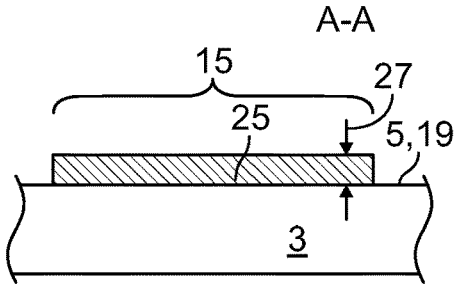
FIG. 5 is a sectional view through the contact surface of FIG. 3 having a coating formed from the partial multilayer particle coating.

FIG. 5 shows an area 15 as shown in FIG. 3 but with several tiers of particles 17 following heat treatment. As in the embodiment described with reference to FIG. 4, a layer 25 consisting of the material of the particles 17 is also formed here. Since an at least partially multilayer arrangement of particles 17 was previously present, as shown in FIG. 3, the layer thickness 27 is larger than in the example described with reference to FIG. 4. The layer thickness 27 can therefore be adjusted following heating by the number of particles 17.

It is also possible here that the material of the particles 17 or layer 25 in FIG. 5 fills recesses or undulations generated previously by the impact of particles 17, such that the material of the layer 25 penetrates at least partially into the contact material 3 and is anchored in the contact material 3 as a result. Likewise, here too only a partial fusing of some particles 17 can be generated instead of a continuous layer 25. This can be achieved, for example, in that the particles 17 are heated at a lower intensity or for a shorter irradiation period.

Figure 6:
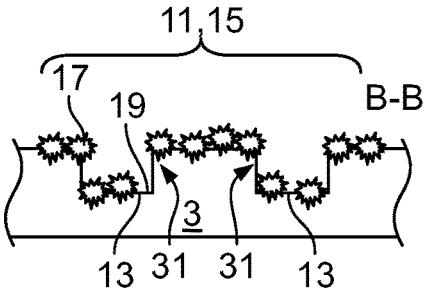
FIG. 6 is a sectional view through a crimp section of the contact having a particle coating.

A second area 15 with particles 17 overlapping the surface structure 11 of the crimp section 7 is shown in FIG. 6. The area 15 with the particles 17 can be formed analogously to the embodiment described with reference to FIGS. 2 and 3. The particles 17 are deposited on the surface 19 and some of the particles 17 penetrate at least partially into the contact material 3. Merely by way of example, FIG. 6 shows a non-continuous coating with particles 17.

The surface structure 11, as formed by the grooves 13, provides both stability and conductivity for a connection of the crimp section 7 with an electrical conductor. In the case of the depicted longitudinal grooves 13, an electrical conductor such as a wire, for example, can be arranged perpendicular to a longitudinal direction of the grooves 13. When the crimp flanks 9 are closed, the electrical conductor is pressed at least partially into the grooves 13 and the areas 31 protruding from the surface 19 are pressed into the material of the conductor. As a result, an electrical conductor is retained securely in the crimp section 7. At the same time, the protruding areas 31, which can in particular have the form of edges, penetrate any oxide layers which may be present on the conductor and improve the electrical connection to the conductor. The particles 17 present on the surface 19, as shown in FIG. 6, penetrate into an inlaid or pressed-in conductor and improve both the mechanical adhesion and the electrical conductivity from the contact material 3 to the electrical conductor.

Figure 7:
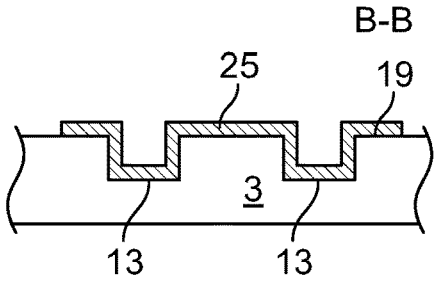
FIG. 7 is a sectional view through the crimp section of FIG. 7 having a coating formed from the particle coating.

FIG. 7 shows the surface structure 11 from FIG. 6 after the particles 17 have been heated. As already described with reference to FIGS. 4 and 5, heating by irradiation with electron beams, for example, can fuse the particles 17 so that a layer 25 is formed. The layer 25 is arranged on the surface structure 11 and covers the whole surface 19 including the grooves 13. As in the previously described examples, here too it can be possible to only heat the particles 17 to the extent that these are fused with one another or surface-fused and substantially retain their particle shape.

What is claimed is:

1. An electrical contact, comprising:

an electrically conductive contact material; and a plurality of particles individually adhered to an area of the contact material, each of the particles penetrating only into the contact material, only into another one of the particles, or only into both the contact material and another one of the particles, and a portion of the plurality of particles at least partially fused to one another.

2. The electrical contact of claim 1, further comprising a contact surface adapted to contact a mating contact.

3. The electrical contact of claim 2, wherein the area at least partially overlaps the contact surface.

4. The electrical contact of claim 1, further comprising a crimp section.

5. The electrical contact of claim 4, wherein the area at least partially overlaps the crimp section.

6. The electrical contact of claim 1, wherein the contact material has a surface structure into which the particles have at least partially penetrated.

7. The electrical contact of claim 6, wherein the surface structure has a free location between the particles through which the surface structure is accessible from an area outside the particles.

8. The electrical contact of claim 1, wherein the area has a surface roughness greater than a surface roughness in an adjacent area without the particles.

9. The electrical contact of claim 1, wherein the particles at least partially penetrate into one another.

10. The electrical contact of claim 1, wherein the particles are arranged in a plurality of layers on the contact material.

11. The electrical contact of claim 1, wherein the particles are formed of a material different from the contact material.

12. A method for altering properties of an electrical contact, comprising:

providing the electrical contact formed from an electrically conductive contact material;

impacting at least one area of the electrical contact with a first plurality of particles, the impact of the plurality of particles deforming the area for increasing a surface roughness of an exposed portion thereof; and depositing a second plurality of particles onto the exposed portion of the area of the contact, the particles are individually adhered to the area of the contact material, each of the particles penetrating only into the contact material, only into another one of the particles, or only into both the contact material and another one of the particles.

13. The method of claim 12, wherein the particles are deposited in a gas flow.

14. The method of claim 12, wherein the particles each have a diameter between 1 and 50 μm.

15. The method of claim 12, further comprising heating at least sections of the contact after the depositing step.

16. The method of claim 15, wherein the heating step is performed using high-energy rays.

17. The method of claim 12, wherein, in the depositing step, a mask is used to allow the particles to only reach a plurality of sections of the contact not covered by the mask.

18. The method of claim 12, wherein the first plurality of particles do not adhere to the surface of the electrical contact.

19. The method of claim 12, wherein a portion of the second plurality of particles are at least partially fused to one another.

20. An electrical contact, comprising:

an electrically conductive contact material having a surface structure; and a plurality of particles adhered to an area of the contact material, each of the particles penetrating only into the contact material, only into another one of the particles, or only into both the contact material and another one of the particles, the particles at least partially penetrating into the surface structure, the surface structure has a free location between the particles through which the surface structure is accessible from an area outside the particles.

* * * * *